US006802687B2

(12) United States Patent
Litchfield et al.

(10) Patent No.: US 6,802,687 B2
(45) Date of Patent: Oct. 12, 2004

(54) METHOD FOR CONTROLLING A RAISE/ EXTEND FUNCTION OF A WORK MACHINE

(75) Inventors: Simon C. Litchfield, Coleorton (GB); C. James Johnson, Coahuila (MX)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/323,858

(22) Filed: Dec. 18, 2002

(65) Prior Publication Data

US 2004/0131458 A1 Jul. 8, 2004

(51) Int. Cl.[7] ..... B66C 23/00

(52) U.S. Cl. ..... 414/699; 414/680; 414/706; 414/800

(58) Field of Search ..... 414/680, 699, 414/706, 800; 37/443; 701/50

(56) References Cited

U.S. PATENT DOCUMENTS 3,618,786 A 11/1971 Fick
3,937,339 A 2/1976 Geis et al.
4,033,468 A * 7/1977 Brown ..... 414/680
4,042,135 A 8/1977 Pugh et al.
4,068,773 A 1/1978 Downing et al.
4,848,010 A * 7/1989 Zimmerman ..... 37/443
4,964,780 A 10/1990 Karvonen
5,189,940 A 3/1993 Hosseini et al.
5,333,533 A 8/1994 Hosseini
5,461,803 A * 10/1995 Rocke ..... 414/699
5,537,818 A 7/1996 Hosseini et al.
5,570,991 A 11/1996 Swenson et al.
5,701,793 A 12/1997 Gardner et al.
6,047,228 A 4/2000 Stone et al.
6,056,503 A 5/2000 Way et al.
6,132,164 A 10/2000 Way et al.
6,336,784 B1 1/2002 Monaghan

* cited by examiner

*Primary Examiner*—Eileen D. Lillis
*Assistant Examiner*—Michael Lowe
(74) *Attorney, Agent, or Firm*—Jeff A Greene

(57) ABSTRACT

A method for controlling the raise/extend function of a work machine is provided. The method comprises sensing the lateral orientation of the work machine, comparing the sensed orientation to a desired orientation and controlling the raise/extend operation in response to the actual verses the desired position.

5 Claims, 4 Drawing Sheets

METHOD FOR CONTROLLING A RAISE/EXTEND FUNCTION OF A WORK MACHINE

TECHNICAL FIELD

The invention relates to a method of controlling the function of a work machine and more particularly to a method of controlling the raise/extend function of a telescopic material handler.

BACKGROUND

Material handling machines, such as telescopic material handlers are faced with stability problems during operation. These machines have these problems because of their high lifting capability, especially when heavy loads are being transported. These problems are even more troublesome when the material handlers are operated on work sites that have uneven terrain and are littered with debris. Many material handlers are provided with high ground clearance involving maintaining as much of the machine as possible elevated from the terrain, especially those elements which extend across the width of the vehicle, such as the axles. While high ground clearance facilitates maneuverability of the material handler it compounds the stability problem because of the elevated center of gravity. The stability problem is particularly acute when the material handlers are required to elevate substantial loads to considerable heights and move about on uneven terrain while balancing the load.

Heretofore in utilizing material handlers on or over uneven terrain or work surfaces, load spilling and machine stability have sometimes been major operational problems. Various attempts have been made to stabilize material handlers in such situations one example is disclosed in U.S. Pat. No. 3,937,339 issued Feb. 10, 1976 to Geis et al. and assigned to Koehring Company of Milwaukee, Wis. This stabilizing system uses two pair of mercury switches, mounted to the body of the machine, one of the pair being actuated at a time to select between coarse and fine adjustment settings. The system automatically, through the use of a solenoid valve, supplies pressurized fluid to a pair of cylinders to level the body of the machine during operation. This system allows for adjustments to counter act uneven terrain while traversing a work sight and during a load lifting operation. However, this system can cause a load to be dumped due to rapid adjustments, inadvertent contact with an obstacle during lifting, let alone the uneasiness in the ride felt by an operator during an adjustment while traversing a work site.

The present invention is directed to overcoming one or more of the following problems as set forth above.

SUMMARY OF THE INVENTION

In one aspect of the present invention a method for controlling a boom raise/extend function of a work machine is provided. The work machine has a longitudinal frame and a support member. The method includes sensing the pressure at both ends of at least one hydraulic cylinder positioned between the frame and the support member. Comparing the sensed force reacted by the at least one hydraulic cylinder to a desired predetermined limit and controlling the boom raise/extend in response to the sensed force being within a predetermined limit.

DETAILED DESCRIPTION

Figure 1:
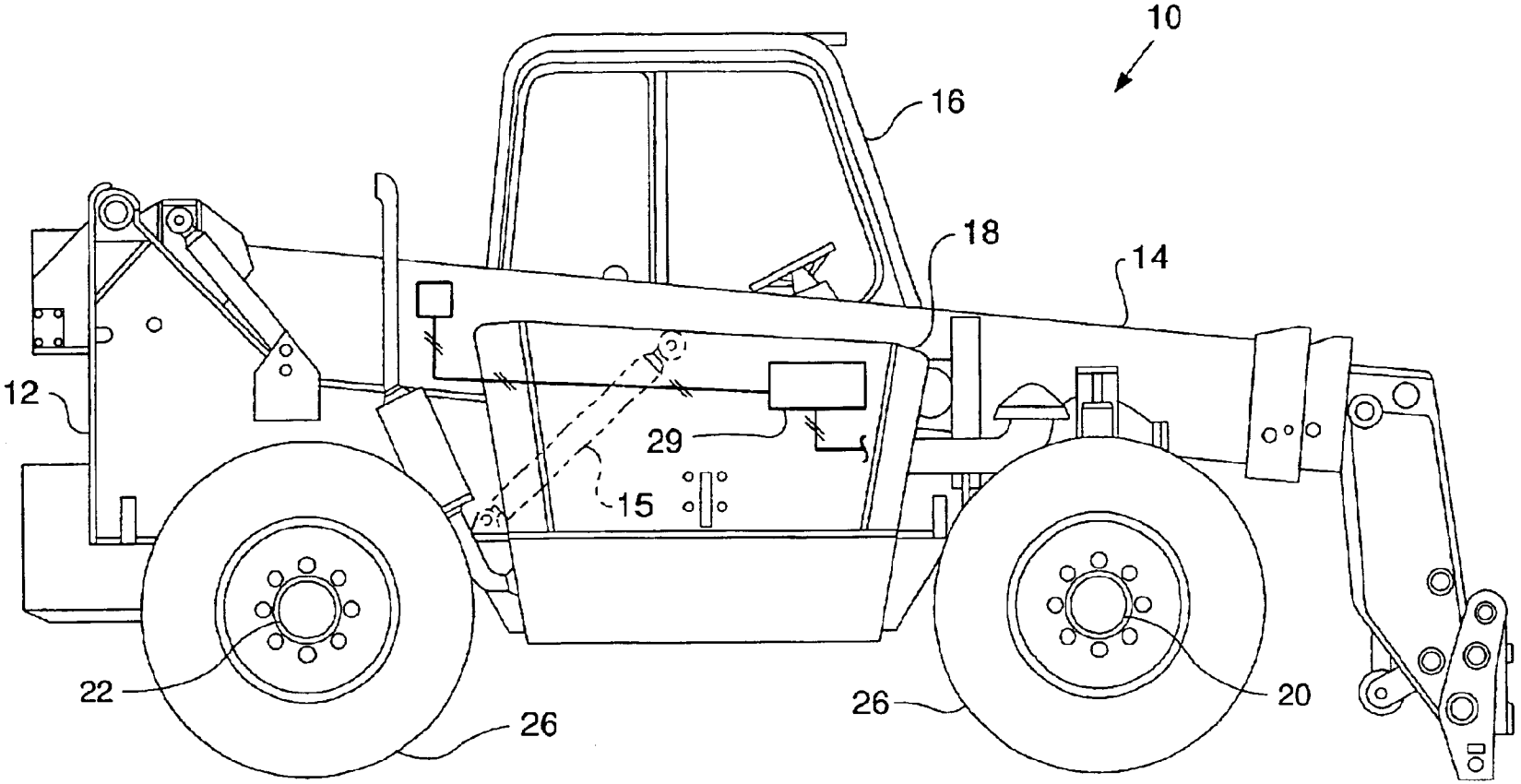
FIG. 1 is a side elevation view of a work machine embodying the present invention.
Figure 2:
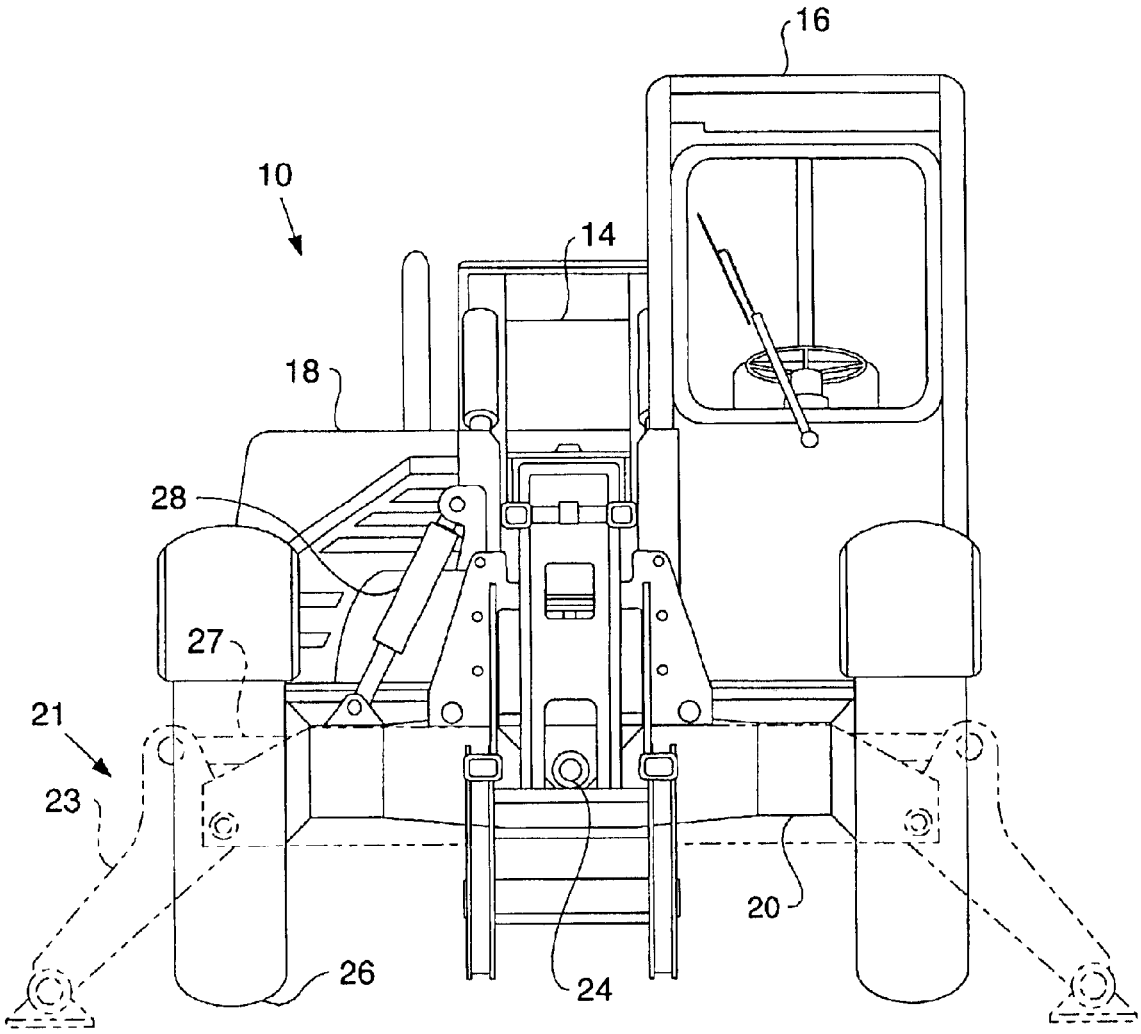
FIG. 2 is a front elevation view of a work machine embodying the present invention.

Referring to FIGS. 1 and 2, a work machine such as a telescopic handler 10 is shown. It will be understood that this invention is equally applicable to other work machines, such as forestry machinery and other non-construction related machinery. In general, the work machine 10 comprises a frame 12, and a telescopic boom 14 that is pivotally mounted to the rear of the frame 12 for elevation to various angles relative to the frame 12. The telescopic boom 12 is extended and retracted by a hydraulic cylinder (not shown) and is raised and lowered by cylinders 15 (only one shown in FIG. 1). In addition, an operator cab 16 is provided on one side of the frame 12, and an engine enclosure 18 is provided opposite the boom 14, so that the boom 14, when lowered, extends between the cab 16 and the engine enclosure 18.

Front and rear support members such as axles 20,22 are pivotally mounted on the frame 12 for oscillating motion about a pivot point 24 parallel to the center-line of the frame 12. The axles 20,22 carry front and rear wheels 26 of equal size, steered by means of hydraulic cylinders in a known manner. At least one hydraulic cylinder 28 is pivotally connected between the frame 12 and the front axle 20 and used to level the frame 12 relative to the ground, one cylinder may be used on either side of pivot point 24 may be used as well, when the machine 10 is operating on uneven terrain. As an alternative, some work machines include a support member 21 attached to the frame 12. As shown in phantom in FIG. 2, support member 21 is an outrigger arrangement that includes a pair of legs 23 that are each controlled by cylinders 27. Graphically represented on the cab 14 in FIGS. 1 and 2 is an electronic control module 29 which will be described in more detail below.

Figure 3:
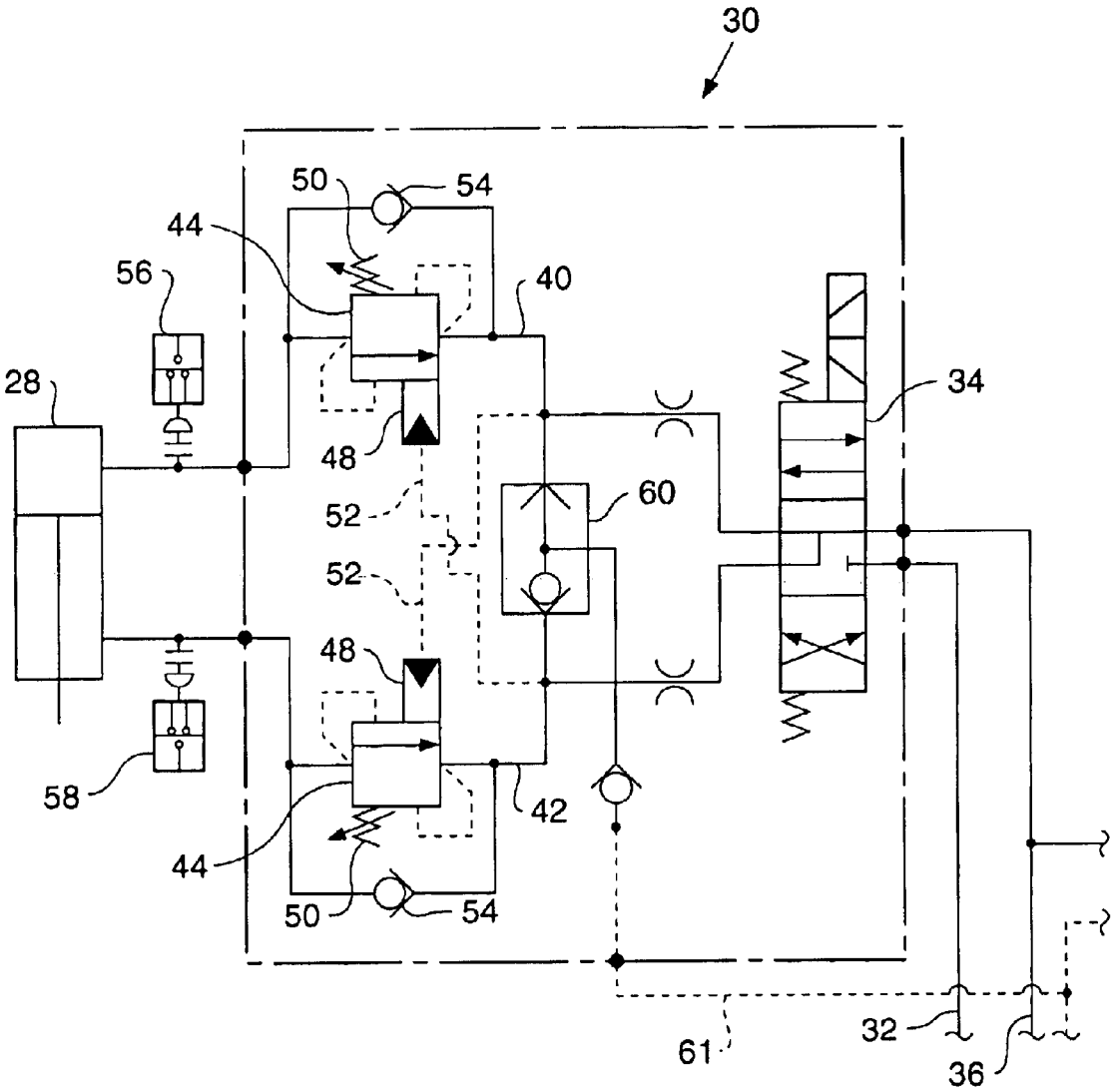
FIG. 3 is a schematic diagram illustrating a portion of a hydraulic circuit of the present invention.

Referring now to FIG. 3 a portion of a lateral stabilization circuit 30 is shown. Lateral stabilization circuit 30 includes a supply conduit 32 that connects a source of pressurized fluid (not shown) to a control valve 34. A return conduit 36 drains the pressurized fluid back from the control valve 34 to a reservoir (not shown). Control valve 34 is a three position, four-way solenoid valve of any of a number of given configurations that is connected to hydraulic cylinder 28 via a conduit 40 and a conduit 42. It should be understood that at least one of hydraulic cylinders 27 may be used in the representative circuit as an alternative without departing from the gist of this disclosure. Positioned in each of the conduits 40,42 is a counter balance valve 44. In this example the counter balance valve 44 is used as a safety device that includes a pilot input 48 and a relief setting arrangement 50. The counter balance valve 44 positioned in conduit 42 includes a pilot line 52 connecting the pilot input 48 to conduit 40, while the counter balance valve 44 positioned in conduit 40 includes a pilot line 52 connecting the pilot input 48 to conduit 42. A check valve 54 is positioned in parallel to each of the counter balance valves 44 so that fluid flow from the cylinder 28 is blocked. A pressure-sensing device 56 is positioned in conduits 40,42 between the cylinder 28 and the counter balance valve 44. One pressure-sensing device 56 is for the head end of cylinder 28 and the other pressure-sensing device 56 is for the rod end of cylinder 28. The pressure-sensing devices 56 are for example pressure transducers 58 that are connected as by wire to the controller 29. Additionally, connected to conduits 40,42 between the counter balance valves 44 and the control valve 34 is a resolver 60 that drains to a signal line 61. Signal line 61 sends a fluid signal representative of load to a controller (not shown) such as a pump controller as is commonly known.

Figure 4:
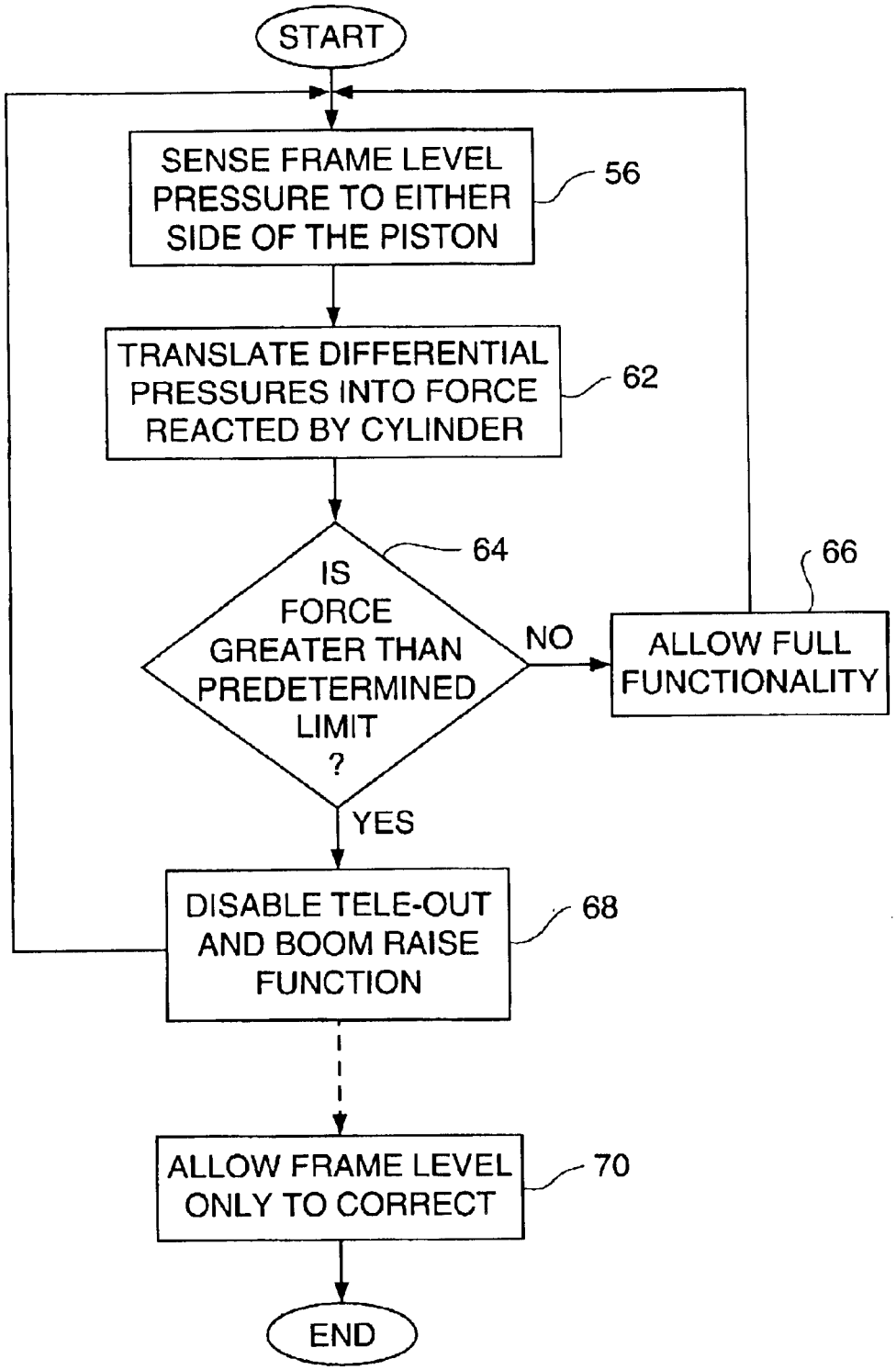
FIG. 4 is a flowchart illustrating the various operational steps.

Referring now to FIG. 4 a method for controlling the lateral stability of work machine 10 is illustrated. The controller 29 receives signals from various operator inputs such as a joystick, control lever or similar input device (not shown) requesting a desired raise/extend operation of the telescopic boom 14 and from the pressure-sensing devices 56. A calculation block 62 calculates the actual force reacted by the hydraulic cylinder 27,28 and compares this force to a predetermined limit in decision block 64. If the calculated force from block 62 is not greater than the predetermined limit a control block 66 of the controller 29 allows signals from the operator controls (not shown) providing full functionality of the telescopic boom 14. If the calculated force from block 62 is greater than the predetermined limit a control block 68 of the controller 29 disables operator controls for raise/extend function. However, lower/retract functionality is still provided. At this point the operators options are provided in a control block 70 and allow the operator to send a signal through an operator input (not shown) to request the controller 29 to send a signal to control valve 34 to shift, allowing pressurized fluid to flow to either hydraulic cylinder 28 or at least one of hydraulic cylinders 27.

INDUSTRIAL APPLICABILITY

In operation a raise/extend input command is provided to controller 30 from the operator to raise/extend the telescopic boom 14. To raise/extend the telescopic boom 14, the controller 30 receives signals from the pressure-sensing devices 56. The controller 30 translates the pressures, sensed in the rod end and head end of either one of hydraulic cylinders 27 or hydraulic cylinder 28, into the actual force being reacted by the hydraulic cylinder 27,28 due to the lateral orientation of the work machine 10 in calculation block 62. The controller 30 then compares the calculated force reacted by hydraulic cylinder 27,28 in block 62 and compares this to a predetermined force, representative to a safe lateral position of the work machine 10, in decision block 64. If the work machine 10 is found to be in a safe lateral orientation control block 66 allows for a load to be raised/extended (i.e. the cylinders 15 to raise telescopic boom 14 or the cylinder to extend telescopic boom 14). If the work machine 10 is not in a safe lateral orientation control block 68 disables the load raise/extend capability of the work machine 10. Control block 70 then allows the operator to maneuver the frame 12 by supplying a command to the hydraulic cylinder 27,28 to laterally position the work machine 10 in a safe position so that a load can be raise/extended. Or the operator can lower/retract the telescopic boom 14 and reposition the work machine 10 in a laterally stable position.

In view of the foregoing it is readily apparent that the method provides a process for controlling the raise/extend function of a work machine 10. The method is for the most part automatic but does allow operator intervention so as to level the frame 12 of the machine 10 relative to the horizontal so as not to put the load or machine in an unstable situation.

What is claimed is:

1. A method for controlling a boom raise/extend function of a work machine, the work machine having a longitudinal frame and a frame support member, said method comprising:

sensing the pressure at both ends of at least one hydraulic cylinder being positioned between the frame and the frame support member;

comparing the sensed pressures to a desired predetermined limit;

controlling the boom raise/extend in response to the comparison between the sensed pressure and the predetermined limit.

2. The method of claim 1, including translating the difference between the sensed pressure at both ends of the hydraulic cylinder into a force.

3. The method of claim 1, wherein controlling the boom raise/extend includes allowing the boom raise/extend function if the force is within the predetermined limit.

4. The method of claim 1, wherein controlling the boom raise/extend includes disabling the boom raise/extend function if the sensed force is not within the predetermined limit.

5. The method of claim 4, including allowing the frame to be leveled until the force is within the predetermined limit.

* * * * *